United States Patent [19]

Joo

[11] 4,371,278

[45] Feb. 1, 1983

[54] MUSICAL PEN

[76] Inventor: Hong K. Joo, 1035-5, Nonhyun-dong, Kangnam-ku, Seoul, Rep. of Korea

[21] Appl. No.: 236,589

[22] Filed: Feb. 20, 1981

[30] Foreign Application Priority Data

Jun. 7, 1980 [KR] Rep. of Korea ..... 1980/3636

[51] Int. Cl.[3] ..... B43K 29/00; G10D 11/00; A63H 5/00

[52] U.S. Cl. ..... 401/195; 84/375; 46/180

[58] Field of Search ..... 401/52, 195; 84/375, 84/330; 46/178, 179, 180

[56] References Cited

U.S. PATENT DOCUMENTS

| | | | |
|---|---|---|---|
| 1,913,457 | 6/1933 | Schlimbohm | 401/52 |
| 3,234,953 | 2/1966 | Moynihan | 401/195 |
| 3,407,021 | 11/1968 | Mosch | 401/195 |
| 3,545,330 | 12/1970 | Nosco | 401/195 |

*Primary Examiner*—Clifford D. Crowder
*Assistant Examiner*—David J. Isabella
*Attorney, Agent, or Firm*—James and Franklin

[57] ABSTRACT

A single portable instrument is capable of use both as a writing device and as a wind instrument.

7 Claims, 3 Drawing Figures

MUSICAL PEN

BACKGROUND OF THE INVENTION

The present invention relates to a novel instrument useful for the production of both music and writing.

It is common for people to carry a writing instrument and, while not quite as common, still common-place for people to carry a small musical instrument—e.g., a harmonica. Those who toil by scribing prose often enjoy the relaxation and recreation afforded by a musical instrument. The advantages of combining a music-producing and writing-producing instrument in one is self-evident: less to carry, less chance to lose one or the other, economy of cost and the like.

Accordingly, it is an object of the present invention to provide a single portable instrument capable of producing both writing and music.

SUMMARY OF THE INVENTION

It has now been found that the above and related objects of the present invention are obtained in a musical pen comprising a barrel having a pair of opposed end openings and a plurality of longitudinally aligned side openings along the length thereof. A pipe, at least partially disposed within the barrel, defines an aperture therethrough providing communication between the upper of the barrel end openings and the plurality of barrel side openings. A resilient strip, secured to the top of the pipe, extends at least partially across the aperture and is adapted to vibrate with the passage of varying levels of air through the aperture. A means for writing, at least partially disposed within the barrel, is adapted to extend partially through the lower of the barrel end openings.

In a preferred embodiment the plurality of barrel side openings are disposed in a row along the length of the barrel, the barrel further defining an additional opening opposite the row of barrel side openings. The top of the pipe is desirably tilted, with the resilient strip being secured to a lower portion of the top of the pipe and extending across the aperture upwardly toward an upper portion of the top of the pipe at a sharper tilt than the pipe.

The writing means is typically slidable along the axis of the barrel between an extended position wherein its lower end extends downwardly from the lower of the barrel end openings and a retracted position wherein its lower end is substantially disposed within the barrel.

Typically means are provided for connecting the pipe and the writing means for travel together as a unit, the connecting means being disposed at least partially within the barrel and extending upwardly through the upper of the barrel end openings. Where the connecting means extends upwardly through the upper of the barrel end openings and has an open top, the musical pen further includes covering means secured to the connecting means and movable between a covering position wherein the covering means closes the open top of the connecting means and an exposing position wherein the covering means exposes the open top of the connecting means so that air may be blown downwardly therethrough into the pipe aperture. The engaging surfaces of the connecting means and the covering means are preferably configured and dimensioned to facilitate manual movement of the covering means to its exposing position.

DETAILED DESCRIPTION OF THE PREFERRED EMBODIMENTS

Figure 1:
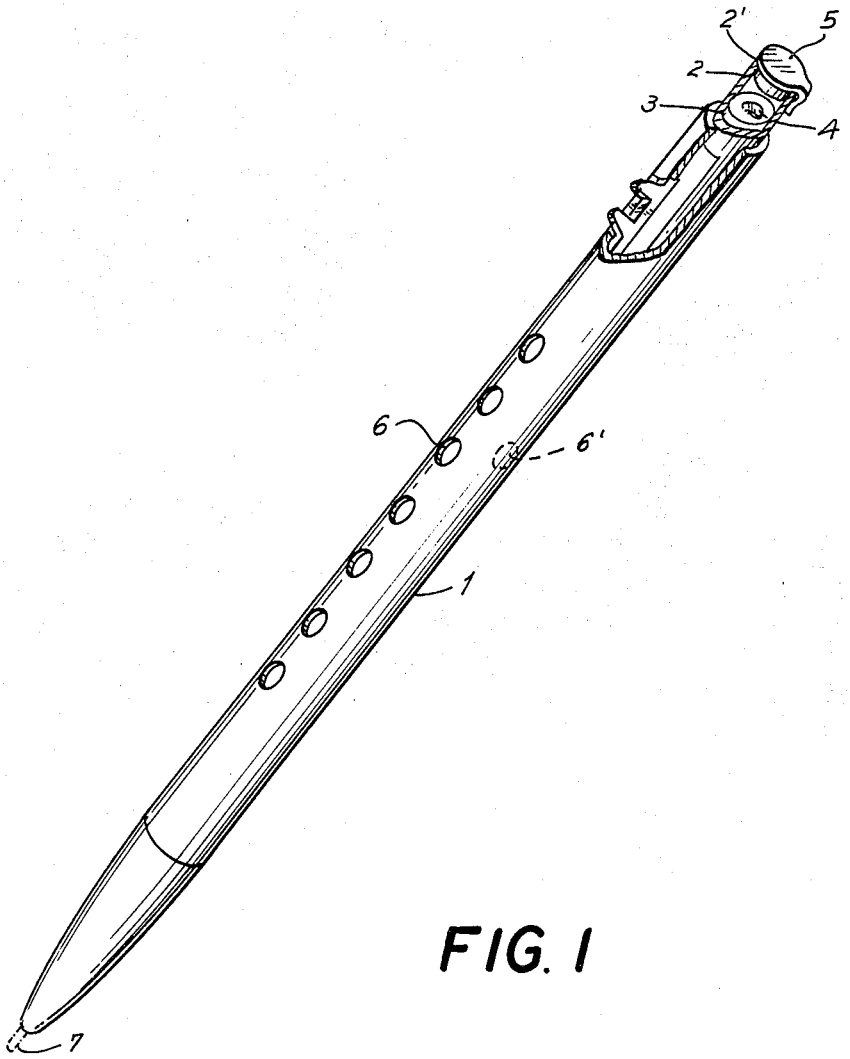
FIG. 1 is an isometric view of a musical pen according to the present invention, with portions being broken away to reveal details of internal construction.
Figure 2:
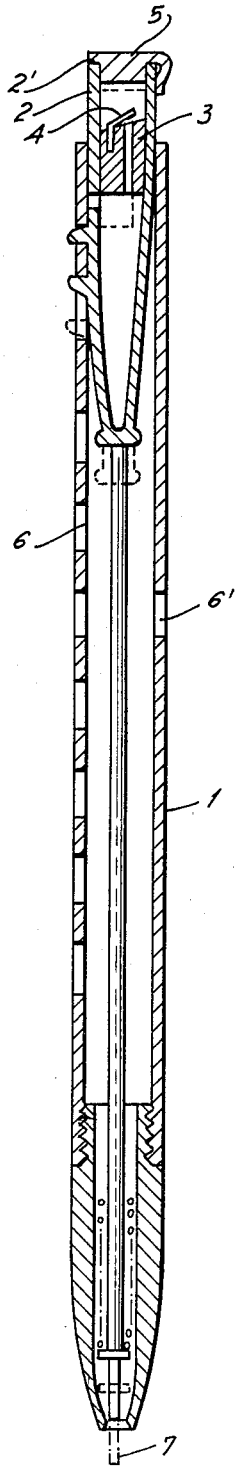
FIG. 2 is a side elevational view thereof, partially in cross-section, with the writing means being shown in phantom line in its extended position to permit use of the pen as a writing instrument.
Figure 3:
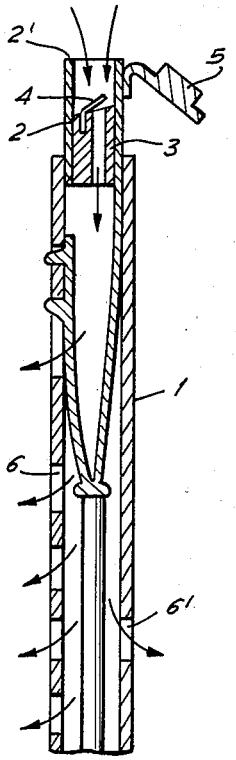
FIG. 3 is a partial side elevational view thereof, partially in cross-section, with the cover means being shown in its exposing position to permit use of the pen as a musical instrument.

Referring now to the drawing, therein illustrated is a pen having an external appearance similar to that of a conventional ballpoint pen, except that the cylindrical barrel 1 of the pen is provided with a row of longitudinally aligned air openings 6 along one side portion thereof and a single air opening 6' on a diametrically opposed side portion thereof. Additionally the barrel 1 is provided with three longitudinally aligned side holes, preferably disposed above the top of the plurality of apertures 6, adapted to receive lugs. Disposed at least partially within the barrel 1 is a conventional spring-loaded writing means 7 (such as a conventional ballpoint pen refill) and button means 2 secured to the top of said writing means 7 for travel therewith and having a pair of lugs adapted to engage the side holes in the barrel 1, thereby to enable the writing means 7 to be disposed in one of two alternative positions. In the retracted position of the writing means (as shown in FIGS. 2 and 3) the bottom or point of the writing means 7 is withdrawn into the lowermost position of the barrel with the projecting lugs of the upper portion of the button means 2 passing through two upper side holes of the barrel 1. In its extended or writing position (as shown in FIG. 1 and in phantom line in FIG. 2), the writing means 7 has its bottom or point extending below the bottom-most portion of the barrel 1 with the two lugs of the upper portion of the button means extending through the two lower side holes of the barrel.

Disposed within the upper portion of the button means 2, which is in turn at least partially disposed within the barrel 1, is a pipe 3 defining a longitudinally extending aperture therethrough. A small strip 4 of resilient material, such as a metal reed, has one end firmly secured to the pipe with the other or free end extending across the top of the aperture of pipe 3. The top of pipe 3 preferably slants upwardly with the secured portion of strip 4 being secured to the lower portion of the pipe top and the free end extending toward the upper portion of the pipe top, but at a sharper angle than the pipe top. In a preferred embodiment the pipe 3 is secured to the button means 2 and disposed therewithin so that as the writing means 7 is displaced between its extended and retracted positions, the pipe 3, strip 4, and button means 2 all undergo similar axial movement.

The button means 2 has an open top and, below the bottom of pipe 3, is either apertured or air-permeable to allow the passage of air from the aperture of pipe 3 outwardly through the air apertures 6, 6' of barrel 1. A covering means 5 is preferably secured to the button means 2 and adapted to be moved between covering and exposing positions. In the exposing position, the covering means 5 exposes the hollow of the button means 2 and enables air to be blown (as shown by the arrows) downwardly through the button means 2, on through the aperture of pipe 3, and finally outwardly through the various air openings 6, 6'. The various air openings 6, 6' are opened or closed by fingers much as one would play any wind instrument to produce a tune. In the covering position the covering means 5 extends across the open top of button means 2, thereby sealing the pipe 3 against dirt while also providing a simple means for moving the button means 2 and the writing means 7 to the extended position relative to the barrel 1. Preferably, the lower surface of the free end of the covering means 5 and the upper surface of the abutting portion of the button means 2 are configured and dimensioned to provide a groove 2' facilitating lifting of the cover means 5 (e.g., by a fingernail) for movement thereof from its covering position to its exposing position.

In order to use the device as a writing instrument, the covering means 5 is put in its covering position and button means 2 is depressed to move the writing means 7 to its extended position, the lugs moving automatically out of the top two lug openings in the barrel 1 and reestablishing themselves in the bottom two lug openings of the barrel 1.

In order to use the device as a musical instrument, the covering means 5 is simply lifted (for example, by a fingernail inserted in the groove 2') and moved to its exposing position. The user then has only to blow downwardly through the open button 2 to cause vibration of the strip 4 as varying levels of air are channeled through the aperture in pipe 3 and hence out of the unplugged air openings 6, 6' of the barrel 1.

To summarize, the present invention provides a single portable device incorporating both a musical instrument and a writing instrument.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing specification.

I claim:

1. A musical pen comprising (A) a barrel having a pair of opposed end openings and a plurality of longitudinally aligned side openings along the length thereof;

(B) a pipe at least partially disposed within said barrel, said pipe defining an aperture therethrough providing communication between the upper of said end openings and said plurality of side openings;

(C) a resilient strip secured to the top of said pipe, extending at least partially across said aperture and adapted to vibrate with the passage of varying levels of air through said aperture; and (D) means for writing at least partially disposed within said barrel and adapted to extend partially through the lower of said end openings.

2. The musical pen of claim 1 wherein said plurality of said side openings are disposed in a row along the length of said barrel, said barrel further defining an additional opening opposite said row of side openings.

3. The musical pen of claim 1 wherein the top of said pipe is tilted, and said resilient strip is secured to a lower portion of the top of said pipe and extends across said aperture upwardly toward an upper portion of the top of said pipe at a sharper tilt than said pipe.

4. The musical pen of claim 1 wherein said writing means is slidable along the axis of said barrel between an extended position wherein the lower end of said writing means extends downwardly from the lower of said end openings and a retracted position wherein the lower end of said writing means is substantially disposed within said barrel.

5. The musical pen of claim 1 additionally including means connecting said pipe and said writing means for travel together as a unit, said connecting means being disposed at least partially within said barrel and extending upwardly through the upper of said end openings.

6. The musical pen of claim 5 wherein said connecting means extends upwardly through the upper of said end openings of said barrel and has an open top, said musical pen further including covering means secured to said connecting means and movable between a covering position wherein said covering means closes said open top of said connecting means and an exposing position wherein said covering means exposes said open top of said connecting means so that air may be blown downwardly therethrough into said pipe aperture.

7. The musical pen of claim 6 wherein the engaging surfaces of said connecting means and said covering means are configured and dimensioned to facilitate manual movement of said covering means to its exposing position.

* * * * *